US009114454B2

(12) United States Patent
Paalanen et al.

(10) Patent No.: US 9,114,454 B2
(45) Date of Patent: Aug. 25, 2015

(54) ARRANGEMENT AND METHOD FOR MOULDS FOR METAL CASTING

(75) Inventors: Seppo Paalanen, Pietarsaari (FI); Arto Rautakoski, Luoto (FI)

(73) Assignee: COMPONENTA OYJ, Helsinki (FI)

( * ) Notice: Subject to any disclaimer, the term of this patent is extended or adjusted under 35 U.S.C. 154(b) by 0 days.

(21) Appl. No.: 14/125,774

(22) PCT Filed: Jun. 13, 2011

(86) PCT No.: PCT/FI2011/050559

§ 371 (c)(1),
(2), (4) Date: Dec. 12, 2013

(87) PCT Pub. No.: WO2012/172154

PCT Pub. Date: Dec. 20, 2012

(65) Prior Publication Data

US 2014/0110075 A1 Apr. 24, 2014

(51) Int. Cl.

| | |
|---|---|
| ***B22C 15/02*** | (2006.01) |
| ***B22C 11/10*** | (2006.01) |
| ***B22C 9/08*** | (2006.01) |
| ***B22C 9/10*** | (2006.01) |

(52) U.S. Cl.

CPC ..... *B22C 15/02* (2013.01); *B22C 9/084* (2013.01); *B22C 9/088* (2013.01); *B22C 9/108* (2013.01); *B22C 11/10* (2013.01)

(58) Field of Classification Search

CPC ..... B22C 11/10; B22C 15/02; B22C 9/088
USPC ..... 164/18, 40, 169, 187, 210, 363, 359, 164/360

See application file for complete search history.

(56) References Cited

U.S. PATENT DOCUMENTS

| | | | | |
|---|---|---|---|---|
| 4,526,338 | A | 7/1985 | Reiland | |
| 2003/0037902 | A1 | 2/2003 | Jacobsen | |
| 2008/0135205 | A1 | 6/2008 | Jezwinski | |
| 2008/0230201 | A1 * | 9/2008 | Skerdi | 164/359 |

(Continued)

FOREIGN PATENT DOCUMENTS

| | | | |
|---|---|---|---|
| DE | 28 03 247 | A1 | 7/1979 |
| DE | 10 2006 055 988 | A1 | 5/2008 |
| EP | 0 738 192 | B1 | 10/1996 |

(Continued)

OTHER PUBLICATIONS

International Search Report, dated Jan. 31, 2012, from corresponding PCT application.

*Primary Examiner* — Kevin E Yoon
(74) *Attorney, Agent, or Firm* — Young & Thompson

(57) ABSTRACT

An arrangement and method in a ram-up machine (1) for moulds (2) for metal casting (10) comprising:—a squeeze plate (3) carrying a first mould pattern (32)—a horizontally movable piston (31) for operating the squeeze plate (3) and a finished mould block (2),—a sand supply system (7)—a swing plate (4) carrying a second mould pattern (42), the swing plate (4) is configured to be translatorily movable in a horizontal direction to a released position (**4*r*) and further to be pivotable upwardly to a sidestep position (4*s*),—a feeder element insertion configuration (50) wherein one or plurality of feeder elements (5) are configured to be attached to the second mould pattern (42) when during operation the swing plate (4) carrying the second mould pattern (42) is pivoted to the sidestep position (4*s***).

12 Claims, 4 Drawing Sheets

(56) References Cited

U.S. PATENT DOCUMENTS

Figure 1:
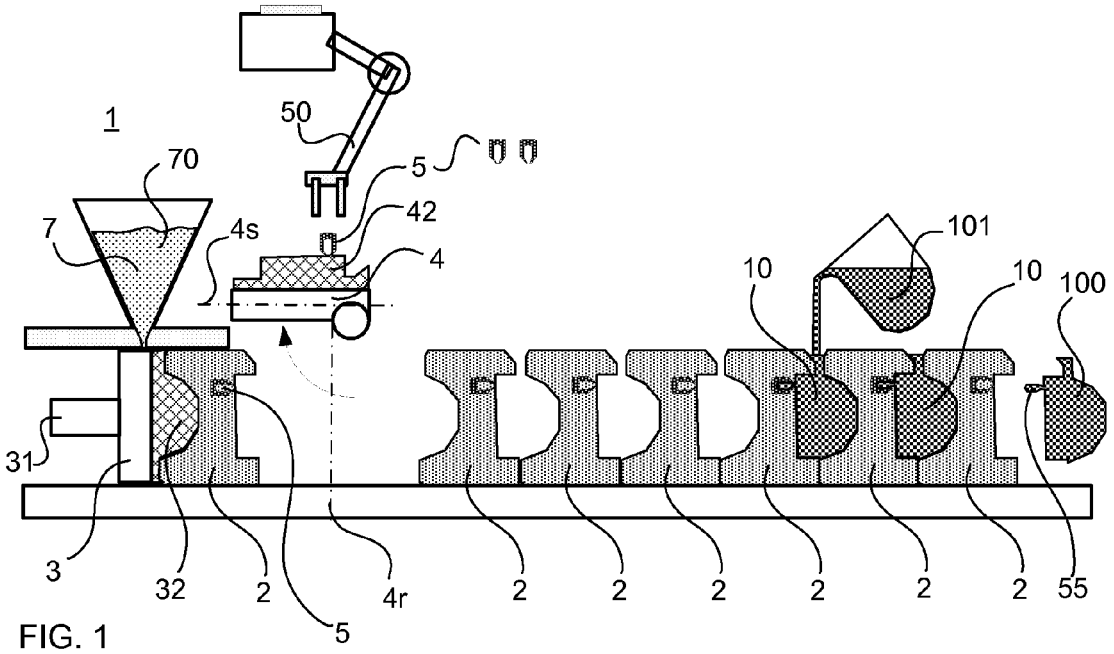

| | | | | |
|---|---|---|---|---|
| 2009/0301684 | A1 | 12/2009 | Beckmann et al. | |
| 2012/0211192 | A1 * | 8/2012 | Sallstrom et al. | 164/359 |

FOREIGN PATENT DOCUMENTS

| | | | |
|---|---|---|---|
| EP | 1 567 294 | B1 | 9/1997 |
| WO | 2009155916 | A1 | 12/2009 |

* cited by examiner

ARRANGEMENT AND METHOD FOR MOULDS FOR METAL CASTING

BACKGROUND OF THE INVENTION

The present invention relates to an arrangement in a ram-up machine for moulds for metal casting comprising:

- a squeeze plate carrying a first mould pattern
- a horizontally movable piston for operating the squeeze plate and a finished mould block,
- a sand supply system
- a swing plate carrying a second mould pattern, the swing plate is configured to be translatorily movable in a horizontal direction to a released position and further to be pivotable upwardly to a sidestep position.

The present invention relates also to a method for ramming up moulds for metal casting in a vertical parting surface ram-up machine comprising:

- after completing a squeeze of a mould block for metal casting, the mould block is pushed to an intermediate position, a swing plate carrying a second mould pattern is separated from the mould block by a translatory move to a released position and then pivoted upwardly to a sidestep position,
- the mould block is pushed out of the ram-up machine by horizontally movable piston operating the squeeze plate carrying a first mould pattern,
- after pushing the mould block out, the squeeze plate returns to an initial position to be ready for mould sand to be supplied,
- the swing plate is pivoted downwardly to the released position and then moved translatory to a ram-up position,
- the mould sand forming the mould block is supplied to a space formed between the squeeze plate located in the initial position and the swing plate located in the ram-up position,
- the squeeze plate and/or swing plate are moved toward each others so that the loose mould sand is rammed up or compressed to form the mould block.

This invention thus relates to mould preparation for metal casting where the parting surface of the mould is vertical. This is one of the many options available in casting and it is particularly suitable for certain shape of products, especially for those being rather small in size, having a rather simple shape and having a kind of "planar like" overall shape. Also if there is an one end supported core needed in the casting, this vertical parting may be the only choice to achieve a successful result. Properties or parameters or types of sand and additives used in this preparation of mould block are not discussed in this disclosure, there are plenty of different variations to select among and it belongs to knowledge of professionals within this area to select a suitable sand and additives.

One principle in metal casting is that the solidifying of molten metal must be controlled is such a way that there are no unwanted shrinkage voids in the casting. In vertical parting surface casting this is normally achieved by designing an extra feeding sleeve so that molten metal flows properly to all parts of the cavity. If an extra supply of molten metal is needed in some part of the casting, a feeding sleeve is normally designed to supply the molten metal to that place. However, if there are too many feeding sleeves around the actual casting piece, the removal of these not part of the product—pieces may require excessive amount of work and thus decrease the profitability.

DESCRIPTION OF THE RELATED ART

EP 0 738 192 B1 discloses a method and equipment for feeding shrinkage voids in metal castings. It claims a mould with vertical parting surface or surfaces, especially for pouring light-metal castings from below, and consisting of two mutually abutting moulds of green sand in a string-moulding plant, said mould comprising at least one mould cavity, an ingate connected to the mould cavity, and an internal after-feeding reservoir connectable to a source of pressurized gas and connected to the mould cavity through a passage with a substantially larger cross-sectional area than that of the ingate, characterized in that the after-feeding reservoir is placed underneath the mould cavity and in a lower part of its side wall is connected to the ingate, and adapted at its bottom to be connected to the source of pressurized gas through a passage opening into an external surface of the mould.

EP 1 567 294 B3 discloses a feeder element and a system for metal casting. A feeder element for use in metal casting, said feeder element having a first end for mounting on a mould pattern, an opposite second end for receiving a feeder sleeve and a bore between the first and second ends defined by a sidewall, said feeder element being compressible in use whereby to reduce the distance between said first and second ends.

The above mentioned feeder element is commonly used in castings having a horizontal parting surface. It is easy to insert the feeder element to the required position and the feeder element remains reliable in the set position during sand supplying and later the during casting feeders let the molten metal to flow upwards above the actual cast component and during the solidifying the metal inside the feeder element may keep up a feeding action until the cast component is solidified.

SUMMARY OF THE INVENTION

The objective of the present invention is to offer an arrangement and a method wherein the the complexity of available shapes and forms in vertical parting surface moulds can be increased and the foundry productivity and gain in quantity and quality aspects can be improved. In terms of energy consumption an objective of the invention is to improve the mould yield so that the amount of cast metal compared to the actual amount (or volume) of the ready cast piece can be reduced, optimum relation would be be nearly one to one. This is interesting for foundries, because the extra metal needs to be molten and it consumes significant amount of energy. All aspects reducing the energy consumption are interesting in economical terms. In above mentioned aspects the mould preparation with a ram-up machine preparing moulds with vertical parting surface is already in quite a high level, the cycle time for making one mould block should remain about the same or improve. Also the automation level in different foundries around the globe is quite different and it would be beneficial, if the invention is suitable for almost all automation levels.

An arrangement according to the present invention is characterised in that a feeder element insertion configuration wherein one or plurality of feeder elements are configured to be attached to the second mould pattern when during operation the swing plate carrying the second mould pattern is pivoted to the sidestep position.

A method according to the present invention is characterised in that after the swing plate carrying the second mould pattern is pivoted upwards to the sidestep position and the squeeze plate is removing the finished mould block, one or plurality of feeder elements are attached substantially vertically to the second mould pattern, when the swing plate is pivoted again downwards and moved to the ram-up position, the feeder elements are located in substantially horizontal direction in their positions, the supplied mould sand covers the feeder elements and when the sand is compressed, a cavity inside the feeder element forms a part of mould cavity in the mould block.

By the claimed features the objectives of the present invention can be achieved. One of the most important aspects achieved is that the freedom of designing a construction to be produced by casting is increased. Those shapes and forms which earlier required complex mould pattern and possibly use of multiple cores may be produced efficiently by using the invention. The controlled solidification can be supported so that a risk of having a void or other casting defect inside the casting piece is reduced. When an experienced casting design engineer or casting simulation notices that there is an increased risk for defect, a mould pattern can be designed so that a feeder element can be inserted in that position to ensure the correct solidification of that part of casting piece. Also by using the feeder elements the mould yield can be improved thus reducing the energy consumption of the process, because it gives more design options if compared to use of conventional feeding sleeves and other arrangements being an integral part of the mould pattern. Also the available area of one mould pattern can be used more effective since the feeder elements can be directed to such direction that it is possible to fit more cast pieces to one mould pattern having about constant dimensions in width and height directions. Also the amount of work required for cleaning the cast piece is reduced.

This arrangement and method can be used with various automation levels for a ram-up machine, from a fully automated version, wherein all functions are automated, to a non-automated version, wherein one operator or plurality of operators manually insert the feeder elements to their position on the second mould pattern during the short period when the swing plate is turned up to the sidestep position.

In the following some embodiments of the arrangement are explained. It is to be understood that in the corresponding method these features of arrangement are used accordingly.

According to one embodiment of the invention the arrangement comprises an insertion frame where the feeder elements are located in their mutually correct positions. This enables the insertion of the feeder elements simultaneously to plurality of position so that the production speed need not to be reduced.

According to one embodiment the arrangement comprises an actuator for inserting the feeder elements to their positions at the second mould pattern. This can be for example a robot type actuator having a grapple for taking the feeder element from a base and inserts it to the correct position. The actuator can repeat this sequence several times if multiple feeder elements are required for one mould pattern.

Still according to one embodiment the arrangement may comprise an actuator having an operable insertion frame comprising set positions for the feeder elements. In this embodiment the functionalities of a frame and an actuator are coupled in such a way that plurality of feeder elements may be inserted simultaneously to given positions. One possibility how this can be achieved is a jig type device having number of simultaneously working grapples. Grapples can be powered for example by electric, pneumatic, hydraulic, magnetic, vacuum operated or corresponding actuators.

According to an embodiment, the arrangement comprises a securing connection between the second mould pattern and the feeder element for securing the feeder element to the second mould pattern. The effect of this feature is to prevent the feeder element from an unintentional release from the surface of the second mold pattern and/or to prevent a misalignment in any direction during pivoting move of swing plate. As the pivoting movement of swing plate is performed relatively short time, this fast movement causes centrifugal forces to the inserted feeder elements.

It is not wanted that the feeder elements are somehow released during this pivoting, stopping the pivoting move or during supplying of the sand. In practice there are many possibilities to ensure the proper securing connection between the second mould pattern and the feeder element. It can be for example magnetic securing, friction locking, bayonette locking, thread locking, push lock, spring lock or corresponding.

BRIEF DESCRIPTION OF THE DRAWING FIGURES

Figure 2A:
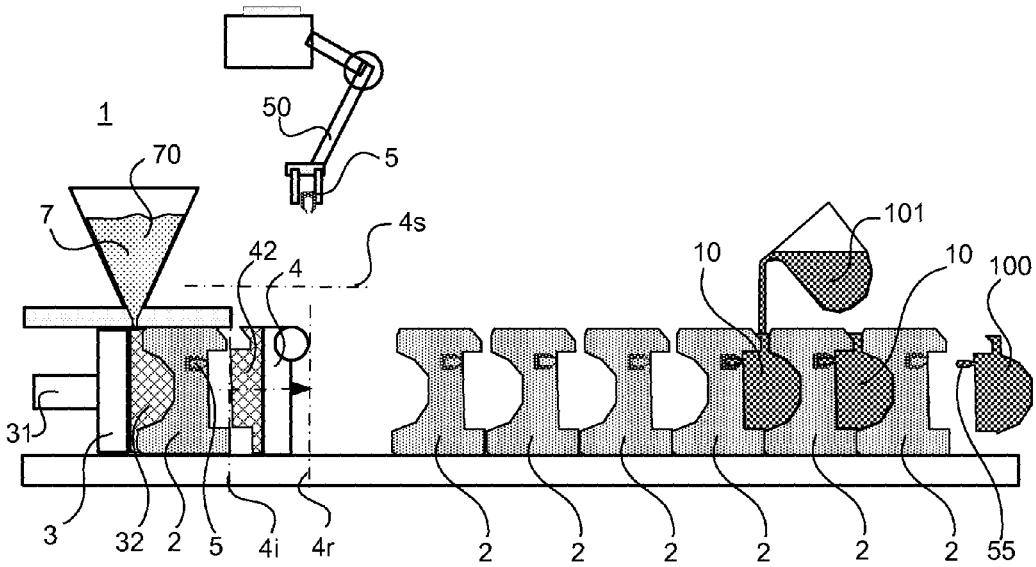
Figure 2B:
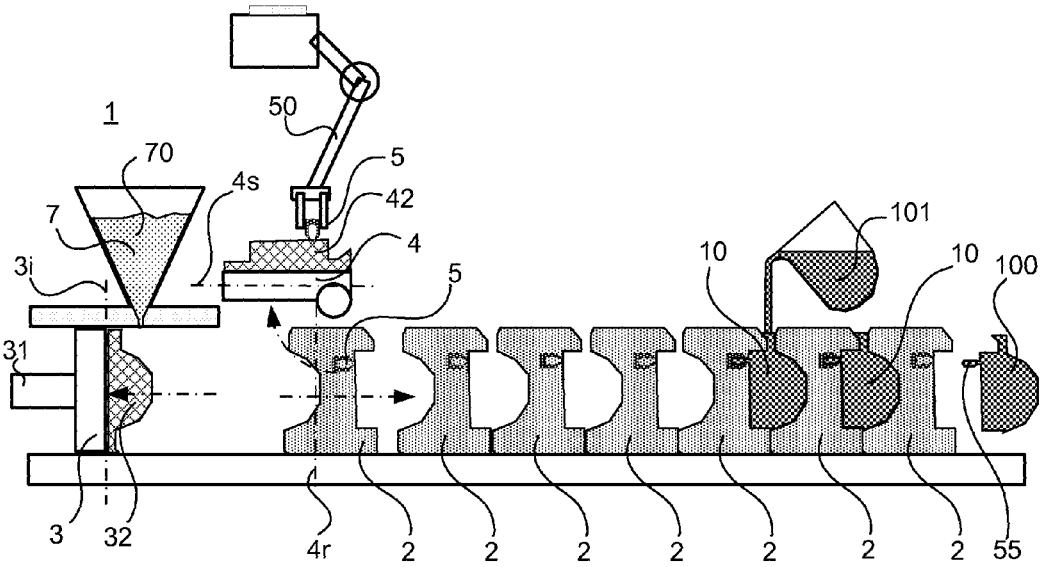
Figure 2C:
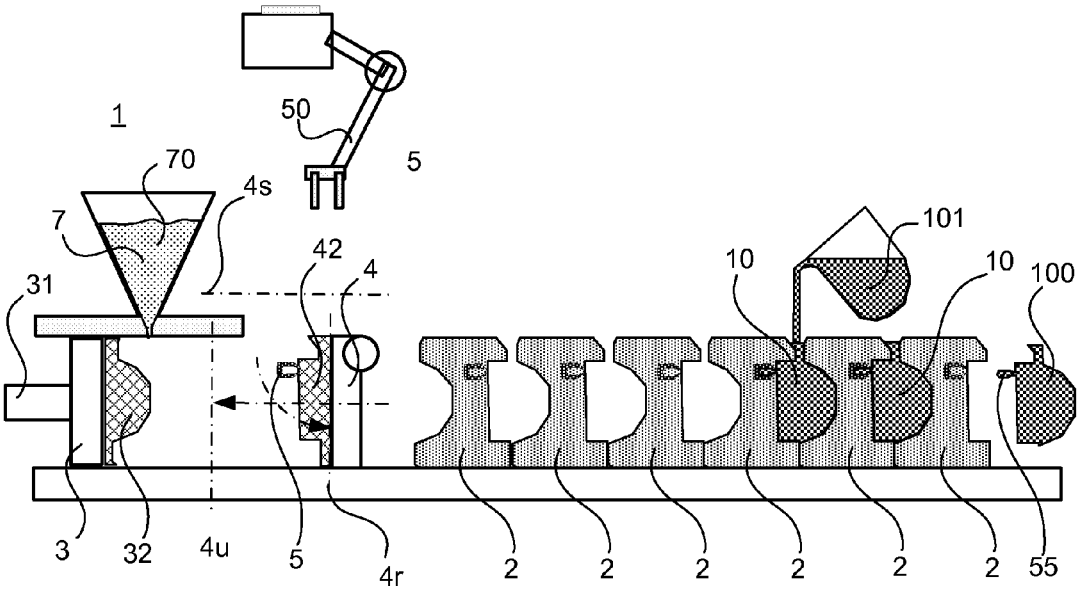
Figure 2D:
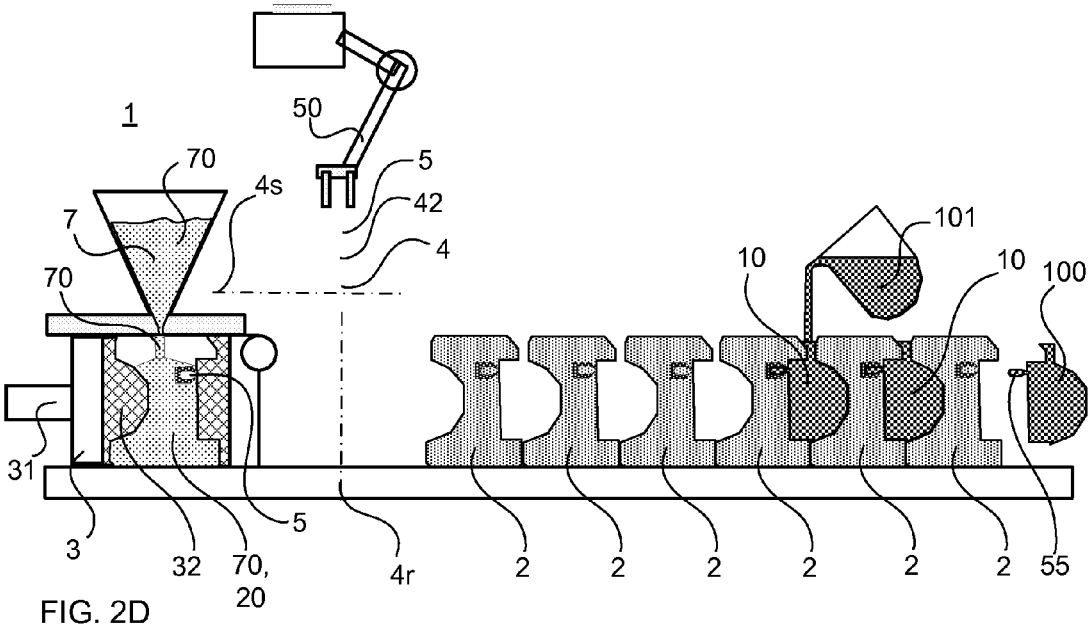
Figure 2E:
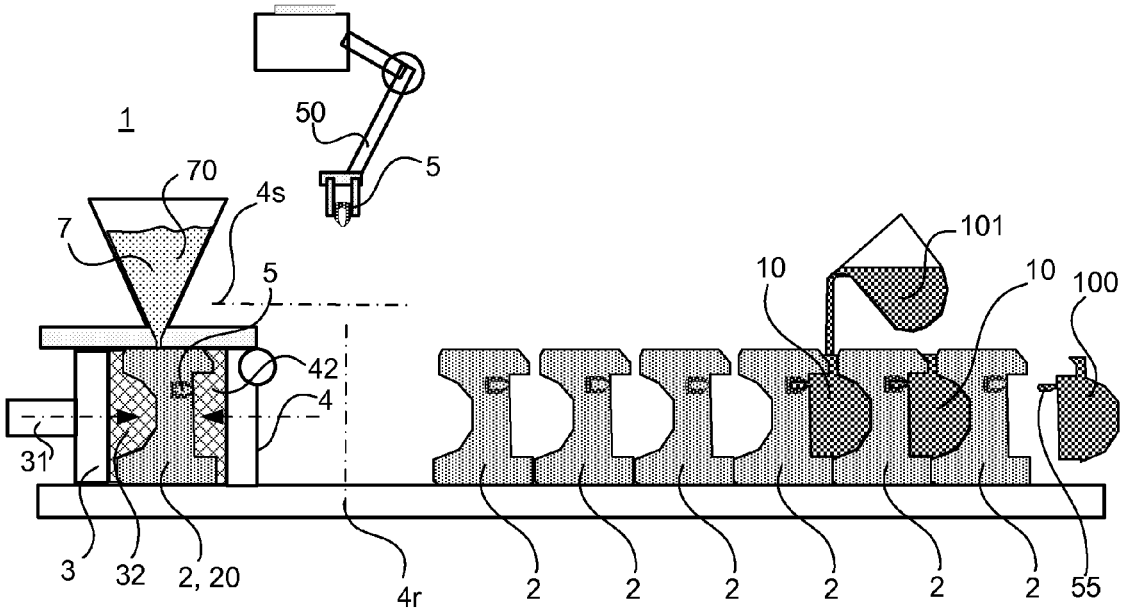
Figure 3:
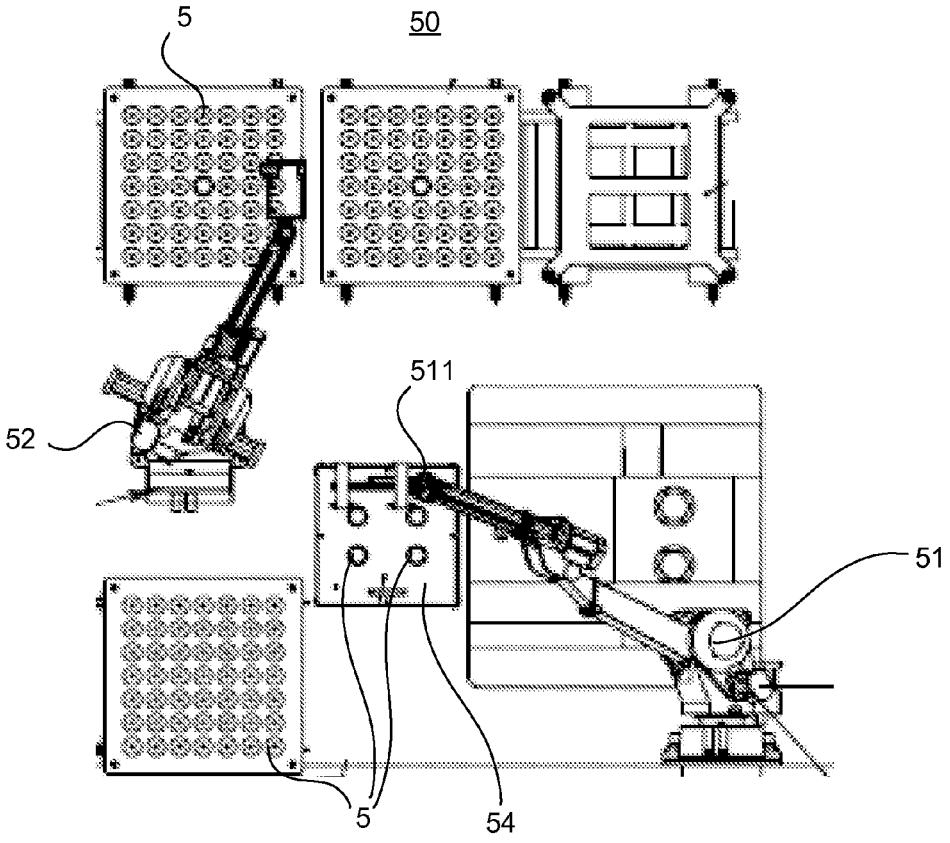

In the following the invention will be disclosed in more detail in connection with the accompanying schematic figures wherein FIG. 1 presents a general view of the ram-up machine, FIG. 2A to 2E presents a operating cycle of a ram-up machine including the arrangement according to the invention, FIG. 3 presents an embodiment of a feeder element insertion configuration.

DETAILED DESCRIPTION OF THE INVENTION

In FIG. 1 it is presented a general over view of an arrangement in a ram-up machine 1 for moulds 2 for metal casting 10 comprising:

a squeeze plate 3 carrying a first mould pattern 32, a horizontally movable piston 31 for operating the squeeze plate 3 and a finished mould block 2, a sand supply system 7 and mould sand 70 in it, a swing plate 4 carrying a second mould pattern 42, the swing plate 4 is configured to be translatorily movable in a horizontal direction to a released position 4*r* and further to be pivotable upwardly to a sidestep position 4*s*, a feeder element insertion configuration 50 wherein one or plurality of feeder elements 5 are configured to be attached to the second mould pattern 42 when during operation the swing plate 4 carrying the second mould pattern 42 is pivoted to the sidestep position 4*s*.

In FIG. 1 it is also presented as illustrative purpose the following casting operation where the molten metal 101 is cast to the cavity between two adjacent mould blocks 2 to form the casting piece 10. Finally at the right in the FIG. 1 the mould blocks have been opened/removed after casting and the casting piece 100 is shown as it is without removing the casting conduits and the cast feeder element 55 and these are shown as a part of cast piece 100.

In figures FIG. 2A to FIG. 2E the procedure of mould preparation is explained in more detail. The features of the arrangement are presented as they were explained in accordance with FIG. 1. In FIG. 2A a method for ramming up moulds 2 for metal casting 10 in a vertical parting surface ram-up machine comprises:

after completing a squeeze of a mould block 2 for metal casting, the mould block 2 is pushed to an intermediate position 4*i*, a swing plate 4 carrying a second mould pattern 42 is separated from the mould block 2 by a translatory move to a released position 4*r* and then pivoted upwardly to a sidestep position 4*s* (as in FIG. 2B).

In FIG. 2B the procedure continues to the following step:

the mould block 2 has been pushed out of the ram-up machine 1 by horizontally movable piston 31 operating the squeeze plate 3 carrying the first mould pattern 32, after pushing the mould block 2 out, the squeeze plate 3 returns to an initial position 3*i* to be ready for mould sand 70 to be supplied, after the swing plate 4 carrying the second mould pattern 42 is pivoted upwards to the sidestep position 4*s* and the squeeze plate 3 is removing the finished mould block 2, one or plurality of feeder elements 5 are attached substantially vertically to the second mould pattern 42. The feeder element insertion configuration 50 can be for example a robot type machine or in the low level automation, it can be performed manually by inserting the feeder elements to their positions during the moment the swing plate is turned upwards to the sidestep position. Thus this attaching of feeder elements to the second mould pattern 42 is preferably 5 performed during the movement of squeeze plate 3, when the squeeze plate moves first to right pushing the mould block 2 our and then returning to the initial position 3*i*. How many i.e. the number of attached feeder elements 5 depends on the design and needs of the cast piece, the objective of the feeder element is to avoid possible quality problems relating to shrinkage of solidifying molten metal.

In FIG. 2C the swing plate 4 is pivoted from sidestep position 4*s* down to the released position 4*r* and then moving translatory to a ram-up position 4*u*. When the swing plate 4 is pivoted downwards and moved to the ram-up position 4*u*, the feeder elements 5 are located in substantially horizontal direction in their positions. This pivoting move is performed relatively fast, so it is preferred to have a securing connection between the second mould pattern 42 and the feeder element 5 for securing the feeder element 5 to the second mould pattern 42. The ram-up position 4*u* can be selected so that a volume of loose sand supplied fills the space between the first mould pattern and the second mould pattern and when compressed, it forms a mould block of proper thickness.

In FIG. 2D the mould sand forming the mould block is being supplied to a space formed between the squeeze plate 3 located in the initial position 3*i* and the swing plate located in the ram-up position 4*u*. The sand is supplied in relatively fast manner so that every notch and pocket of the first and second mould pattern is filled properly. Sometimes this mould sand supply is called sand blowing or sand shooting. If the sand does not fill the space between the first mould pattern and the second mould pattern there would be a quality defect in the casting piece also. As the sand is supplied powerfully, the sand hitting the feeder element causes also bending or corresponding forces, which the feeder element 5 must withstand. When all the sand is supplied, the feeder element or feeder elements are buried in the sand. The cavity inside the feeder element 5 is not filled with sand because the open end of the feeder element 5 is locked to the second mould pattern 42.

In FIG. 2E it is shown a stage, where all the mould sand 70 is supplied, the supplied mould sand 70 in the space 20 covers also the feeder elements 5. Then the squeeze plate 3 and/or swing plate 4 are moved toward each others so that the loose mould 70 sand is rammed up or compressed to form the mould block 2 and when the sand is compressed, a cavity inside the feeder element 5 forms a part of mould cavity in the mould block. It is possible to arrange the ram-up machine so that the squeeze plate 3 and/or swing plate 4 are moved toward each others. This and/or means that either the squeeze plate or swing plate 4 are moved toward each others or both the squeeze plate 3 and swing plate 4 are moved toward each others. After this sequence step shown in FIG. 2E the procedure continues again from step shown in FIG. 2A.

In FIG. 3 it is presented an embodiment of a feeder element insertion configuration 50 from above. According to an embodiment the arrangement may comprise an insertion frame where the feeder elements are located in their mutually correct positions to be set to the second mould pattern. According to another embodiment the arrangement may comprise an actuator 51 for inserting the feeder elements to their positions at the second mould pattern. This actuator can put the feeder element or feeder elements to their position in consequent order or at one step. The feeder elements set to one mould pattern in all of the explained embodiments can be of same type or of different type, for example different in volume, dimensions, thicknesses, having thermally different properties etc.

Still according to one embodiment the arrangement may comprise an actuator having an operable insertion frame 511 comprising set positions for the feeder elements 5. This can be for example a multiple grapple type construction where the operable insertion frame may take several feeder element simultaneously and insert them to the positions with one move.

According to an embodiment the same feeder insertion configuration can also be configured for inserting the feeder element in an inclided position, to prevent a rotation of the feeder element, to insert a chill for casting, to insert a core and/or to insert a filter. These other purposes are kind of optional features and they may require some additional elements especially at the grapple area. Inserting the feeder element in an inclined position may sometimes be beneficial to obtain an optimal flow of molten metal or removal of casting gases. Also the inserting of a chill for casting may be preformed in addition to inserting a feeder element 5. The chill can be used to low down the temperature of molten metal in certain spot more than in some other place. As a consequence the solidification can be for example started by this chill for casting. This is kind of opposite function to a feeder element which keeps the metal molten longer. Filters are normally inserted by core setter or manually prior to actual casting, but this configuration may allow a filter to be inserted during mould block preparation. Purpose of this kind of filter is to prevent impurities or slag to enter to the casting cavity with the molten metal.

The specific examples and embodiment provided in the description given above should not be construed as limiting. Therefore, the invention is not limited merely to the embodiments described above.

REFERENCE SIGNS USED IN FIGURES

1 ram-up machine
10 metal casting
100 casting piece
101 molten metal
2 mould block
20 space for mould block
3 squeeze plate
3*i* initial position
31 squeeze plate piston
32 first mould pattern
4 swing plate
42 second mould pattern
4*i* intermediate position
4*r* released position
4*s* sidestep position
4*u* ram-up position

5 feeder element
50 feeder element insertion configuration
51 actuator
511 operable insertion frame
52 actuator
55 cast feeder element
7 sand supply system
70 mould sand

The invention claimed is:

1. An arrangement in a ram-up machine (1) for moulds (2) for metal casting (10) comprising:

a squeeze plate (3) carrying a first mould pattern (32), a horizontally movable piston (31) for operating the squeeze plate (3) and a finished mould block (2), a sand supply system (7) that provides mould sand (70), a swing plate (4) carrying a second mould pattern (42), the swing plate (4) configured to be translatorily movable in a horizontal direction to a released position (4*r*) and further to be pivotable upwardly to a sidestep position (4*s*), a feeder element insertion configuration (50), wherein one or plurality of feeder elements (5) are configured to be attached to the second mould pattern (42) when, during operation, the swing plate (4) carrying the second mould pattern (42) is pivoted to the sidestep position (4*s*) and an insertion frame (54) where each of the one or more feeder elements (5) is located in a mutually correct position to be set to the second mould pattern (42).

2. The arrangement of claim 1, further comprising another actuator (52) loading the feeder elements (5) to or for the insertion frame (54).

3. The arrangement of claim 1, further comprising an actuator (51) for inserting the feeder elements (5) to their positions at the second mould pattern (42).

4. The arrangement of claim 1, further comprising an actuator (51) having an operable insertion frame (511) comprising set positions for the feeder elements (5).

5. The arrangement of claim 1, further comprising a securing connection between the 25 second mould pattern (42) and the feeder element (5) for securing the feeder element (5) to the second mould pattern (42).

6. The arrangement of claim 1 wherein the feeder element insertion configuration (50) is also configured for inserting the feeder element (5) in an inclinded position, to prevent a rotation of the feeder element, to insert a chill for casting, to insert a core and/or to insert a filter.

7. A method for ramming up moulds for metal casting in a vertical parting surface ram-up machine comprising the steps of:

after completing a squeeze of a mould block (2) for metal casting, pushing the mould block (2) to an intermediate position (4*i*), a swing plate (4) carrying a second mould pattern (42) is separated from the mould block (2) by a translatory move to a released position (4*r*) and then pivoted upwardly to a sidestep position (4*s*), pushing the mould block (2) out of the ram-up machine by horizontally movable piston (31) operating the squeeze plate (3) carrying a first mould pattern (32), after pushing the mould block (2) out, the squeeze plate (3) returns to an initial position (3i) to be ready for mould sand (70) to be supplied, pivoting the swing plate (4) downwardly to the released position (4*r*) and then moved translatory to a ram-up position (4*u*), supplying the mould sand (70) forming the mould block (2) to a space (20) formed between the squeeze plate (3) located in the initial position (3*i*) and the swing plate (4) located in the ram-up position (4*u*), moving the squeeze plate (3) and/or swing plate (4) toward each others so that the loose mould sand (70) is rammed up or compressed to form the mould block (2), after the swing plate (4) carrying the second mould pattern (42) is pivoted upwards to the sidestep position (4*s*) and the sqeeze plate (3) is removing the finished mould block (2), using a feeder element insertion configuration (50) to attach one or more of feeder elements (5) to the second mould pattern (42), the one or more of the feeder elements (5) being attached substantially vertically to the second mould pattern (42), when the swing plate (42) is pivoted again downwards and moved to the ram-up position (4*u*), the feeder elements (5) are located in substantially horizontal direction in their positions, the supplied mould sand (70) covers the feeder elements (5) and when the mould sand (70) is compressed, a cavity inside the feeder element (5) forms a part of mould cavity in the mould block (2) and an insertion frame (54) where each of the one or more feeder elements is located in a mutually correct position to be set to the second mould pattern (42).

8. The method of claim 7 further comprising using an actuator (51) which inserts the feeder elements (5) to their positions at the second mould pattern (42).

9. The method of claim 7 further comprising using an actuator (51) having an operable insertion frame (51*l*) comprising set positions for the feeder elements (5).

10. The method of claim 7 further comprising using an actuator (52) loading the feeder elements (5) to or for the insertion frame (54).

11. The method of claim 7 further comprising using a securing connection between the feeder element (5) and the second mould pattern (42) for securing the the feeder element (5) to the second mould pattern (42) by inserting the feeder element (5) to its position on the second mould pattern (42).

12. The method of claim 7 comprising method step wherein the feeder element insertion configuration (50) may insert the feeder element (5) in an inclinded position, prevent a rotation of the feeder element, insert a chill for casting, insert a core and/or to insert a filter.

* * * * *